United States Patent [19]

Robertson

[11] Patent Number: 5,062,406

[45] Date of Patent: Nov. 5, 1991

[54] ATTACHMENT FOR CROSSBOW THAT SHOOTS ARROWS TO ENABLE THE CROSSBOW TO SHOOT SLUGS

[76] Inventor: David H. Robertson, P.O. Box 3625, Palmer, Ak. 99645

[21] Appl. No.: 392,442

[22] Filed: Aug. 11, 1989

Related U.S. Application Data

[63] Continuation-in-part of Ser. No. 143,951, Jan. 14, 1988, abandoned.

[51] Int. Cl.[5] ..... F41B 5/02

[52] U.S. Cl. ..... 124/25; 124/84; 124/22; 124/26

[58] Field of Search ..... 124/25, 24 R, 26, 22, 124/21, 24.1, 84, 83, 86, 27

[56] References Cited

U.S. PATENT DOCUMENTS

| | | | |
|---|---|---|---|
| 230,896 | 8/1880 | Sanftleben . | |
| 320,643 | 6/1885 | Engle . | |
| 334,575 | 1/1886 | Engle . | |
| 380,371 | 4/1888 | Walker . | |
| 650,411 | 5/1900 | Myers | 124/25 |
| 2,313,803 | 4/1941 | Carlson . | |
| 2,918,050 | 12/1959 | Kopman | 124/25 |
| 3,050,046 | 8/1962 | Jones | 124/25 |
| 3,483,857 | 12/1969 | Jones | 124/25 |
| 3,515,113 | 6/1970 | Lawrence . | |
| 3,527,195 | 9/1970 | Corlo . | |
| 3,581,729 | 6/1971 | Jones | 124/25 |
| 3,643,643 | 2/1972 | Jordan . | |
| 3,739,765 | 6/1973 | Moore | 124/25 |
| 3,788,299 | 1/1974 | Mathews | 124/35 R |
| 3,949,729 | 4/1976 | Pfotenhauer | 124/22 X |
| 3,963,017 | 6/1976 | Pfotenhauer | 124/21 |
| 4,241,716 | 12/1980 | Tsui | 124/27 |
| 4,565,183 | 1/1986 | Smith | 124/26 |
| 4,688,539 | 8/1987 | Lawrence | 124/84 X |
| 4,696,281 | 9/1987 | Nishioka | 124/25 |
| 4,827,893 | 5/1989 | Nishioka | 124/25 |
| 4,947,822 | 8/1990 | Jones et al. | 124/25 X |

FOREIGN PATENT DOCUMENTS

| | | |
|---|---|---|
| 2147213 | 5/1985 | United Kingdom . |

*Primary Examiner*—Peter M. Cuomo
*Attorney, Agent, or Firm*—William D. Hall

[57] ABSTRACT

Apparatus is provided to shoot both arrows and slugs. A crossbow has a longitudinal groove for guiding a feather of an arrow being shot by the crossbow. An attachment may be added to the crossbow to enable the crossbow to shoot slugs. When the attachment is used two longitudinal grooves cooperate to form a bore to guide the slugs.

34 Claims, 2 Drawing Sheets

ATTACHMENT FOR CROSSBOW THAT SHOOTS ARROWS TO ENABLE THE CROSSBOW TO SHOOT SLUGS

RELATED APPLICATION

This application is a continuation in part of my prior copending application Ser. No. 07/143,951, filed Jan. 14, 1988, and entitled Crossbow Device, now abandoned.

BACKGROUND OF THE INVENTION

This invention relates to a device for guiding projectiles propelled by the bow string of an ordinary crossbow, and particularly an improved device for shooting slug-like projections, such as pellets or bullets.

Crossbows have been known and used for many hears for such things as hunting and personal protection. Crossbows were originally conceived to propel arrows toward a target over greater distances and with greater velocity than existing conventional bows. With the advent of firearms, it became desirable to propel other projectiles, such as slugs, ball bearings or bullets. The concept of firing such projectiles from a crossbow type launcher also became popular, as evidenced by the prior art. There are several advantages to using slug or ball-type projectiles, rather than arrows, in combination with crossbow devices. The cost of even the cheapest conventional crossbow arrow can be up to twenty or thirty times greater than for a conventional .357 slug. In addition to the reduced cost of slugs, a ball, such as a ball bearing propelled from the same crossbow as a conventional arrow of comparable weight, will travel roughly twice the distance.

Although crossbow devices that propel projectiles other than arrows are known, these devices have achieved such a result by redesigning the entire crossbow commencing with an entirely new structural configuration which better suits the various needs of slug-type pieces. These devices have generally redesigned the crossbow from the ground up, as it were. Because of this, there have been several problems with such devices. The first is that while many of these designs allow the firing of projectiles such as slugs, they do not alternatively allow the firing of conventional crossbow arrows. Even those devices that do offer dual firing capability have been designed as complete devices, rather than as an add on unit which a user can easily affix to an already existing crossbow as an attachment. The cost of purchasing another entire crossbow that has slug projectile firing capability is prohibitive to many who would otherwise find dual firing capability, in an already owned crossbow, useful.

SUMMARY OF THE INVENTION

Crossbows, which were well known prior to my invention had an elongated barrel with a vertical slot, running from behind the arrow to the free end of the barrel, for guiding the feather of an arrow. My invention may be applied to the existing crossbows just referred to. My invention is in two forms. In both forms I have an elongated strip that may be placed in a parallel relation to the top surface of the barrel. This strip has a groove in its underside and which extends along the strip directly above said slot in the barrel. This strip may be removably attached to the crossbow.

In the first form of my invention the slot in the barrel of the crossbow does not cooperate with the groove in the strip to form a desirable guide for the slug that I desire to fire from the crossbow. The reason for this lack of cooperation is that the slot in the barrel of the crossbow is not the correct size. Therefore, in addition to said strip, I provide an elongated member with a vertical flange to fit snugly in the vertical slot of the barrel of the crossbow. This elongated member has a groove in its upper side so that groove cooperates with the groove in said strip to form a suitable elongated hole through which the slug may pass after it is fired.

In the second form of my invention, said elongated member is not required, since the vertical slot in the barrel of some crossbows is a correct size to directly cooperate with the groove in the strip of my invention to form a hole through which a slug may be fired.

In both forms of my invention there is a door through which a slug may be inserted in said hole immediately ahead of the bowstring (when the latter has been placed in firing position). A spring-biased cover may be slid over the door to hold it closed until the slug is fired.

The rear end of said strip forms a fork with two parallel rearwardly extending members which may be fastened to the body of the cross Moreover, the front end of said strip is affixed to the front end of the crossbow.

DETAILED DESCRIPTION OF THE INVENTION

It is, therefore, an object of this invention to provide an economical attachment conversion device that can be used with existing crossbows.

Another object of the invention is to provide an attachment device that fires slug-like projectiles.

Yet another object of the present invention is to offer the capability of firing many different sized projectiles.

Still another object of the present invention is that it is easily removable to allow selective firing of arrows or slug-like projectiles.

Another object of the present invention is to provide a device capable of dual firing with few moving parts.

Yet another object of the present invention is a device that can easily and quickly convert a crossbow to slug projectile firing capability.

These and other objects are satisfied by an attachment device for crossbows, containing a top track, a substantially parallel bottom track, a hinged door loading mechanism and a safety cover for said door, that allows slug-like projectiles to be fired from an existing crossbow.

Figure 5:
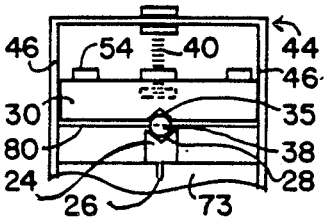
FIG. 5 is a front view of the device mounted on a crossbow.

As can readily be appreciated in viewing FIGS. 1–6, device 10 is designed to be an add-on accessory for use with existing crossbows. Referring specifically to FIGS. 3–6, lower track 24 has flange 26 which is adapted to be press fit into the existing groove of stock 13 of crossbow 12 which usually accommodates the feather of an arrow. Lower track 24 provides a generally flat, thin rectangular surface, and is constructed of aluminum metal or material of similar structural rigidity. Track 24 is designed to terminate at end of stock 13. Upper surface 27 of lower track 24 is provided with a milled center groove 28 that runs down the entire length of the track. Groove 28 is formed by two opposite cuts made at the same angles in relation to the plane of the upper surface 27. Groove 28 cooperates with complementary channel 35 of top track 30 as shown in FIG. 5, to form barrel 55 of device 10, and provides a guide for the bottom of a slug-like projectile 38 when the crossbow 12 is fired. The depth and angles of the cuts that form the groove 28 vary according to the type of ball or slug that is desired to be projected.

Referring now to FIGS. 1, 2, 5, and 6, top track 30 of device 10 can be seen in more detail and in relation to lower track 24. Top track 30 is somewhat larger than lower track 24. As seen clearly in FIGS. 1 and 2, top track 30 provides a generally flat, thin rectangular surface, is rounded at its front end and has a U-shaped cutout 32 at its rear or fork-shaped end 68. Track 30 is designed to terminate at the end of stock 13 (see FIG. 6), and is constructed of aluminum metal or another material of substantially the same structural rigidity. Bottom surface 34 of track 30 has a channel 35 that runs longitudinally down the center of track 30 and loading door 52. Channel 35 is formed, in the same manner as groove 28, in lower track 24, by two opposite cuts made at the same angles in relation to the plane of bottom surface 34, and cooperates with groove 28 of lower track 24 to form a guide for slug-like projectile 38 to be propelled along by bow string 80 (See FIG. 5). Depth and angles of channel 35 also vary according to the type of ball or slug to be projected.

Figure 1:
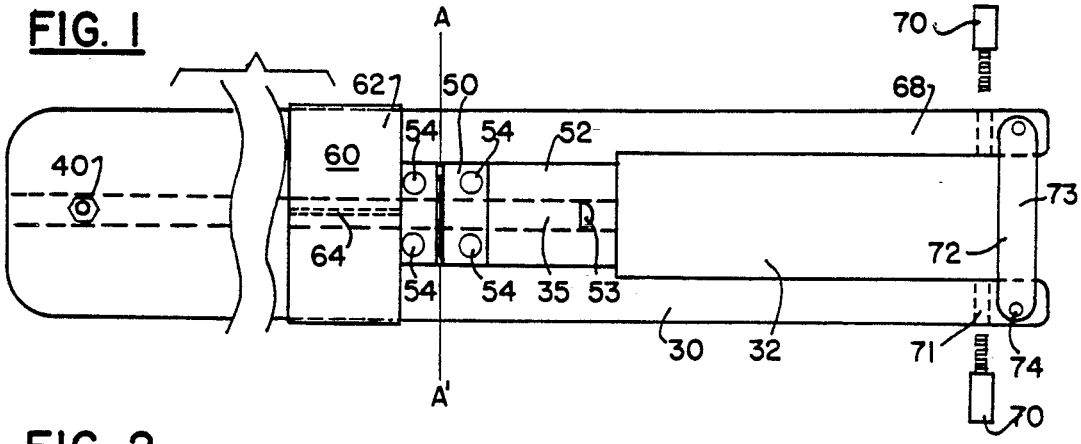
FIG. 1 is a top view of the present invention.
Figure 2:
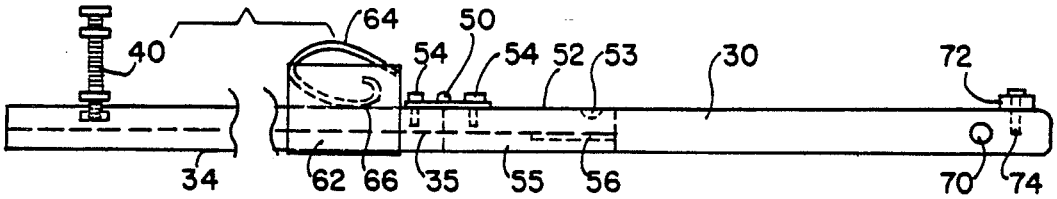
FIG. 2 is a side view of the top track, according to the present invention.
Figure 3:
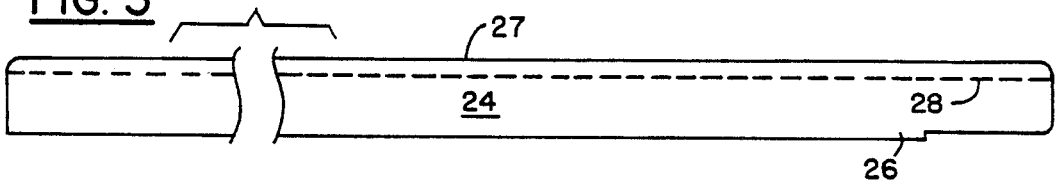
FIG. 3 is a side view of the bottom track, according to the present invention.
Figure 4:
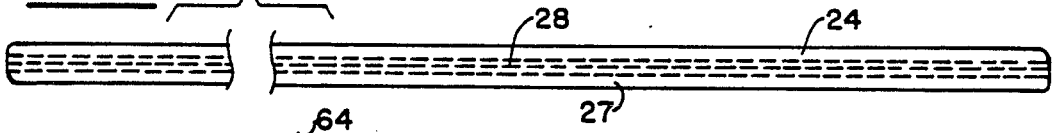
FIG. 4 is a top view of the bottom track of the present invention.
Figure 6:
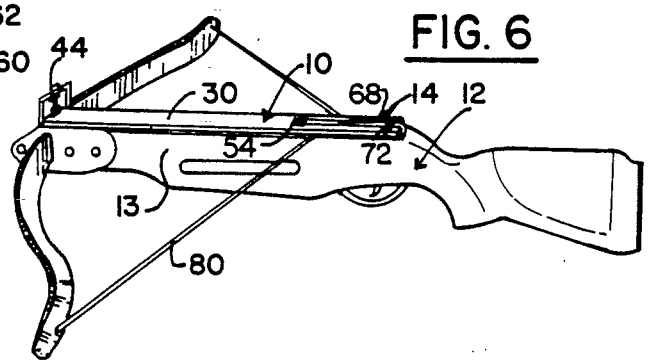
FIG. 6 is a perspective view of the device mounted on a crossbow. In view of the generality of FIG. 6, it shows both forms of the invention.

Moving from left to right along top track 30 in FIGS. 1 and 2, screw 40 is located in the center of track 30, and is countersunk from the bottom and held in place at its lower end. Screw 40 serves two important functions. First, it serves to hold top track 30 in place as shown in FIG. 5 and it acts as a sight for aiming purposes. Sight bracket 44 holds the front part of top track 30 stationary and in proper position by parallel posts 46 that are attached to either side of stock of crossbow 12, as shown in FIG. 6. Secondly, it permits the spacing between the top track 30 and the stock 13 to be adjusted. Moving now to the center portion of top track 30, hinge 50 serves to connect top track 30 to pivotable loading door 52. Hinge 50 is held in place by hinge screws 54. As previously described, door 52 has a channel 35 cut into its bottom surface to guide projectile 38 when it is fired. Top surface of door 52 provides a depression 53 to assist in opening door 52 to load slug-like projectile 38 into device. When loading is desired, hinge 50 is pivoted upward about A—A' axis, as shown in FIG. 1. Projectile 38 can then be dropped into groove 28 of lower track 24. Door 52 is then pivoted back into a closed position and projectile 38 occupies the barrel 55 formed by channel 35 and groove 28. Projectile 38 is held in position and prevented from rolling by resilient member 56, located on upper surface of channel 35 that tensions projectile 38 against groove 28 until such time as crossbow 12 is fired and bow string 80 propels projectile 38 along the barrel in the manner shown in FIG. 5.

Figure 7:
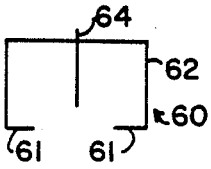
FIG. 7 is a front view of the loading mechanism cover, according to the device.

Once projectile 38 is loaded into barrel 55, manually movable cover 60 is used to keep door 52 closed and projectile tensioned against resilient member 56. Cover 60, as shown in FIGS. 1, 2 and 7, consists of two main parts: housing 62 and tensioning member 64. Housing 62 has dual flanges 61 that frictionally engage lower surface 34 of top track 30 to keep it attached thereto, and define a sliding engagement between cover 60 and track 30. Tensioning member 64 is substantially enclosed by housing 62, and is located in the center and partially protrudes through the top thereof. Cover 60 is shown, in FIGS. 1 and 2, in position to allow loading of projectile 38 by raising door 52. Once projectile 38 is loaded into barrel 38 and door 52 is closed, cover 60 is slid over hinge 50 and door 52 toward the rear or forked end 68 of top track 30, until the bottom of tensioning member 66 engages depression 53 in door 52. Cover 60 thereby locks door 52 in a closed position and keeps projectile 38 against resilient member 56 while crossbow 12 is being carried or aimed. After crossbow 12 has been fired and reloading is desired, cover 60 is then slid over door 52 and hinge 54 in opposite manner toward the front of top track 30 to the position shown in FIGS. 1 and 2, allowing door 52 to be pivoted open and device 10 to be reloaded.

Moving now toward the rear of top track 30, fork-shaped end 68 fits around trigger housing 14 that is part of crossbow 12. When U-Shaped cutout 32 is abutted against trigger housing 14, top track 30 is thereby aligned and positionally stabilized. Top track 30 is then secured by tightening threaded knobs 70 in apertures 71, until they exert a sufficient tensioning force on side of housing 14 to fasten the rear end of top track 30 of device 10 to crossbow 12. Bar 72 consists of a thin rectangular plate 73 with two downwardly projecting members 74 that are substantially perpendicular to rectangular plate 73. Projecting members 74 are inserted into corresponding holes in fork-shaped end 68 of top track 30 prior to any tightening of knobs 70. Bar 72 prevents fork-shaped end 68 from spreading apart when knobs 70 are tightened against housing 14.

FIGS. 1 to 5 show the first form of my invention.

Figure 8:
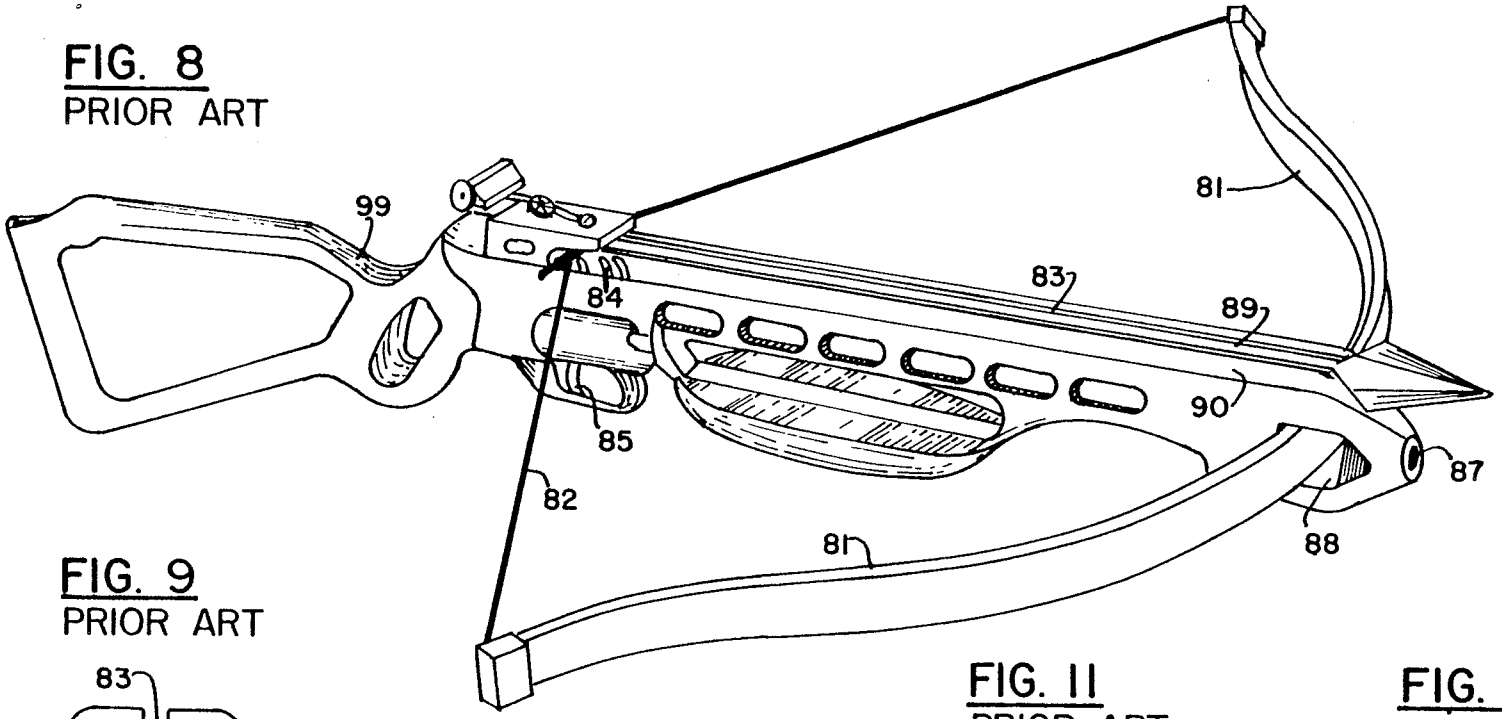
FIG. 8 PRIOR ART
FIG. 8 is a perspective view of a prior art crossbow that will shoot arrows.
Figure 12:
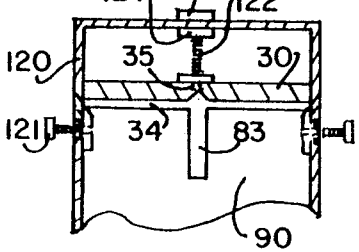
FIG. 12 is a sectional view of the support for the front end of my new attachment.

The crossbow 99 of FIG. 8 is a Barnett Wildcat XL manufactured by Barnett International Inc., Dock Meadow Drive, Lanesfield, Wolverhampton, West Midlands, England WV46UD. FIG. 12 shows the second form of the invention.

Figure 11:
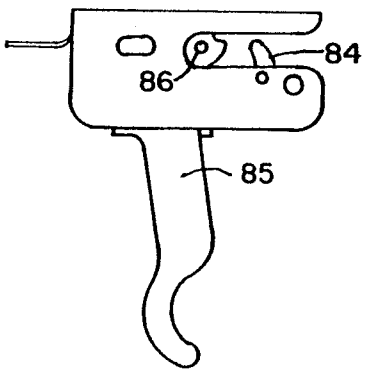
FIG. 11 PRIOR ART
FIG. 11 illustrates the trigger and its associated parts of the crossbow of FIG. 8.
Figure 9:
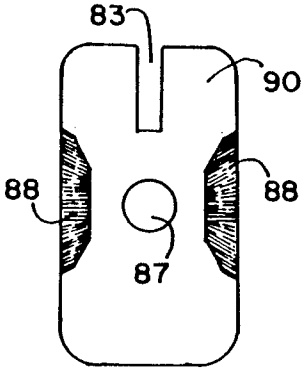
FIG. 9 PRIOR ART
FIG. 9 is a front view of the crossbow of FIG. 7.

FIGS. 8, 9 and 11 show a conventional crossbow which is part of the prior art and which has a vertical slot 83 of suitable dimensions so that the lower track 24 (FIG. 3) is unnecessary. In other words, groove 35 in upper track 30 will cooperate directly with the vertical slot 83 in barrel 90 to form a suitable hole for a slug to pass after the slug is fired. See FIG. 12).

The crossbow 99 of FIG. 8, has a barrel 90 terminating at its front end in a plate 87 which may show the trademark of the manufacturer. A slot 88 passes horizontally through the front end. The crossbow, of FIG. 8, fires an arrow 89 which arrow has a feather (not shown) which is guided by vertical slot 83 when the arrow 89 is fired. Until the trigger 85 (FIGS. 8 and 11) is pulled the bowstring 82 of bow 81 is restrained by rotatable stop 84. When the trigger 85 is pulled the stop 84 is released so that the bowstring 82 can now easily rotate stop 84 out of the way in the conventional manner so that the bowstring 82 now moves forward at high velocity and shoots the arrow 89 at the target. The crossbow 99 also has a safety catch 86 (FIG. 11) which may be operated to prevent the crossbow from firing accidentally.

Figure 10:
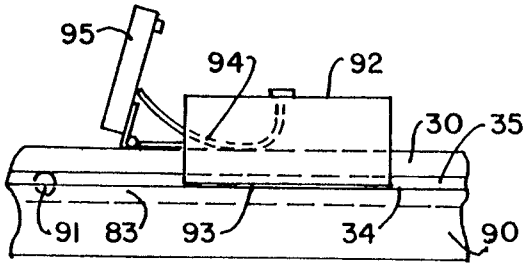
FIG. 10 is a side view, partly in section, of a cover for the door of my invention.

Next assume that it is desired to shoot slugs instead of arrows. The word slug includes articles such as a spherical metal ball, or of bullet shape (including metal articles that taper at the nose end). The strip 30 (FIGS. 1 and 2) is then added to the stock of crossbow 89. At its rear end, strip 30 (also sometimes referred to as the upper track) is fastened to the crossbow 89 using threaded knobs 70 as shown in FIG. 6. The front end of strip (or upper track 30) is held in position by frame 120 which is fastened to the portion 90 of crossbow 99 by bolts 121. The frame 120 supports screw 122 which in turn supports the front end of strip (or upper track 30). The nuts 123 and 124 enable the front end of strip 30 to be raised or lowered to provide the preferred spacing between groove 35 (FIGS. 1, 2 and 5) and vertical slot 83 of FIGS. 8 and 9. To raise the front end of strip 30, the nut 124 is rotated to move downward along screw 122 and nut 123 is then tightened to raise the front end of strip 30. Screw 122 may also be used as a sight for aiming the crossbow. When the strip 30 is properly positioned relative to slot 83, a slug may now be inserted just ahead of the bowstring 82 and in the space between groove 35 and slot 83. This may be done using the door 52 of FIG. 2 and the spring means 62, 64, an 66 to hold the door closed (as explained above in connection with FIGS. 1 and 2). A modified form of spring means as shown in FIG. 10 may be used to hold the door closed. In FIG. 10 the door 95 is similar to door 52 of FIGS. 1 and 2. It may be opened to insert slug 91 in firing position (resting on barrel 90 at the upper end of slot 83). After the slug 91 is inserted the door 95 is closed and spring means 92, 93, and 94 is slid to a position over the door so that spring 94 biases the door 95 shut. The spring means 92, 93, and 94 has the same shape as cover 60 of FIGS. 1 and 2 except that the shape of spring 94 is a little different. Spring means 92 has two flanges extending partly across and below the underside 34 of strip 30 to hold the spring means 92, 93, and 94 in place and to enable it to slide over door 95 and also to enable it to slide back to the position shown in FIG. 10.

Once the strip 30 is mounted on the crossbow 99, a slug properly inserted in firing position, and door 95 is closed and locked with spring means 92, 93, and 94 the crossbow 99 is ready to shoot the slug 91. This is done by pulling the trigger 85.

If it is again desired to shoot arrows, the strip 30 is removed from crossbow 99, and an arrow inserted as shown in FIG. 8.

I claim to have invented:

1. In a device for shooting either arrows or slugs:

a crossbow defining an elongated groove and having means for shooting arrows with a feather of the arrow guided by said groove, said crossbow having a bow string, a removable elongated guiding means which when added to said crossbow enables the crossbow to shoot slugs, said removable elongated guiding means when added to said crossbow cooperating with said elongated groove to provide apparatus having two parallel elongated grooves that form a barrel for the slug fired by the crossbow, means for removably supporting said elongated guiding means on said crossbow so that when said elongated guiding means is removed from said crossbow that the crossbow may be used to shoot arrows, said elongated guiding means forming, with said crossbow, a slot that extends along at least a limited length of said barrel, said bowstring passing laterally through said slot, so that a slug may be shot out of said barrel.

2. In a device as defined in claim 1:

said projectile guiding means having a portion that fits in said elongated groove and thereby supports said portion, said portion defining a groove that constitutes one of said two parallel elongated grooves.

3. In a device as defined in claim 1:

said means for removably supporting said elongated guiding means including means for positioning said elongated guiding means adjacent said elongated groove, said elongated guiding means having only one groove, said one groove cooperatively directly with said elongated groove to form said two parallel elongated grooves, said means for positioning said elongated guiding means comprising means for enabling the crossbow to shoot slugs when said elongated guiding means is adjacent said elongated groove and for permitting said crossbow to shoot arrows when said elongated guiding means is removed from the vicinity of said elongated groove.

4. In a device as defined in claim 1:

said crossbow having opposing side walls and a trigger, and fork means having two parallel arms for securing said elongated means to said opposing side walls, respectively, adjacent said trigger.

each arm having a screw which may be screwed inward from the arm to engage the crossbow and secure the fork means to the crossbow, and spread preventing means removably attached to said arms for preventing the arms from spreading apart as said screws move inward.

5. In a device as defined in claim 4 in which said parallel arms, said bow string, and said hole, are in a common plane.

6. In a device as defined in claim 1:

said elongated guiding means having an opening through which a slug may be passed to thus located the slug in said barrel immediately in front of said bow string, and a door which may be opened and closed for covering said opening after a slug has been inserted in the barrel.

7. In a device as defined in claim 6:

means slidable along said projectile guiding means and including spring means for holding said door closed.

8. In a device as defined in claim 1 in which said elongated guiding means is a strip that is thin as compared to its width and which has a side which faces said crossbow, one of said parallel groves being in said side.

9. In a device as defined in claim 8, in which:

said strip has a door which when open permits a slug to be placed immediately in front of said bow string.

10. In a device as defined in claim 1 in which said elongated guiding means has a door which may be opened to enable a slug to be positioned immediately in front of said bow string.

11. In a device as defined in claim 10 in which said door has a wall facing said crossbow, said wall defining a groove which is a part of one of said parallel grooves.

12. In combination:

a crossbow defining an elongated groove and having means for shooting arrows with a feather of the arrow guided by said groove, said crossbow having a bowstring, a removable elongated guided means which when added to said crossbow enables the crossbow to shoot slugs, said removable elongated guided means when added to said crossbow cooperates with said elongated groove slug to provide apparatus having two parallel elongated grooves that form a barrel for the slugs fired by the crossbow, said elongated guided means having an elongated guiding portion, said removable elongated guide means including mounting means for removably mounting said elongated guiding portion adjacent to and spaced from said elongated groove, said removable elongated guide means and said crossbow forming means, including a barrel between said parallel grooves, for receiving a slug immediately in front of said bow string and for guiding a slug that is shot by said bowstring.

13. A device as defined in claim 12, in which:

said elongated guide means having an end remote from said bow string, said mounting means including adjusting means adjacent said end for adjusting the space between said grooves.

14. A device as defined in claim 13 in which said adjusting means also comprises a sighting device for enabling the user of the crossbow to aim at a target.

15. A device as defined in claim 12 in which said mounting means forms a bridge over said elongated guide portion and includes adjusting means extending from the bridge to the elongated guide portion for adjusting the space between said elongated guide portion and said cross bow.

16. A device as defined in claim 15 in which said adjusting means also comprises means for enabling the user of the device to sight on a target.

17. A device as defined in claim 12 in which said elongated guiding portion is a strip that is thin as compared to its width and which has a side which faces said cross bow, the groove in said elongated guiding portion being in said side.

18. A device as defined in claim 17, in which:

said strip has a door which when open permits a slug to be placed immediately in front of said bow string.

19. A device as defined in claim 12 in which said elongated guiding portion has a door which may be opened to enable a slug to be positioned immediately in front of said bow string.

20. A device as defined in claim 19 in which said door has a wall facing said crossbow, said wall defining a groove which is part of the elongated groove of said elongated guiding portion.

21. A device as defined in claim 12 in which said elongated guiding means includes another guide portion that fits in said elongated groove of the crossbow and has an outer face that faces said elongated guiding portion, said outer face defining an elongated groove that cooperates with and is spaced from the groove in said elongated guiding portion to form said barrel.

22. A device as defined in claim 12 in which said elongated guide means consists of said elongated guiding portion so that the respective grooves in said elongated guiding portion and in said crossbow form parts of a passageway for a slug shot by said bow string.

23. In a device for enabling a stock having a cross bow associated therewith to fire slug-type projectiles as well as arrows, said crossbow having a bow string, said stock, crossbow and bow string comprising means for shooting an arrow of the type that has at least one feather, said means defining a longitudinal groove along the path of such arrow, which is shot by the device, for guiding a feather of such arrow:

a first projectile guiding means which has a surface defining a second groove;

a second projectile guiding means which has a surface defining a third groove, said second projectile guiding means being in a separate piece from said first projectile guide means so that it can be separately mounted on and removed from said cross bow, means that is mounted in said longitudinal groove, for removably supporting said second projectile guiding means on said stock so that said second projectile guiding means may be removed from said cross bow, and means for removably holding said first projectile guiding means in operative relation with said second projectile guiding means so that said second and third grooves cooperate to form a hole that freely permits said slug type projectile to pass through said hole, and so that said first projectile guiding means may be removed from said crossbow, said first and second projectile guiding means cooperating to form a slot that extends along at least a limited length of said hole, said bowstring passing laterally through said slot, said first projectile guiding means being farther away from said stock than said second projectile guiding means, so that when said first projectile guiding means is in operative relation to said second projectile guiding means a slug-type projectile in said hole may be shot out of the device by said bowstring, and when both of said first and second projectile guiding means are removed, from the crossbow, the crossbow may shoot arrows.

24. In a device as defined in claim 23:

said first projectile guiding means and said second projectile guiding means cooperating to form a firing position for said slug and including resilient means for pressing a slug against one of said guiding means to hold a slug in firing position until it is moved forward by said bowstring.

25. In a device to be added to a crossbow which defines an elongated groove and has means for shooting arrows with a feather of the arrow guided by said groove, said crossbow having a bowstring, said device comprising:

a removable elongated guiding means which when added to said crossbow enables the crossbow to shoot slugs, said removable elongated guiding means when added to said crossbow cooperating with said elongated groove to provide apparatus having two parallel elongated grooves that form a barrel for the slugs fired by the crossbow, said guiding means, having an opening through which a slug may be passed in order to place the slug in a firing position in front of said bowstring, means for removably supporting said guiding means on said crossbow so that when said guiding means is removed from said crossbow that the crossbow may be used to shoot arrows, a door covering said opening, said door maintaining said opening closed when the door is closed and said door permitting a slug to be fed through said opening to said firing position when the door is open.

26. In a device as defined in claim 25:

said barrel having a longitudinal hole therethrough, said door having an inner side, said door having a longitudinal groove on its inner side which becomes part of the hole through said barrel when the door is closed.

27. In a device as defined in claim 26, in which:

said elongated guiding means has an end remote from said bow string, said means for removably supporting said elongated guiding means including means adjacent said end for adjusting the space between said parallel grooves.

28. In a device as defined in claim 27 in which said adjusting means also comprises a sighting device for enabling the user of the crossbow to aim at a target.

29. A device as defined in claim 27 comprising mounting means for supporting said end, said mounting means forming a bridge over said elongated guiding means, said adjusting means extending from said bridge to the elongated guiding means for adjusting the space between said elongated guiding portion and said crossbow.

30. A device as defined in claim 29 in which said adjusting means also comprises a sighting means for enabling the user of the device to sight on a target.

31. In a device as defined in claim 25:

said door having an outer side, and clamp means on the barrel slidable over the outer side of the door when the door is closed in order to hold the door closed.

32. In a device as defined in claim 31:

said clamp means including spring means for biasing said door closed when said clamp means has been moved to a position over said door.

33. A device as defined in claim 25 wherein said guiding means includes a removable element that fits in said groove of the crossbow and has an outer face, said outer face having one of said parallel grooves for guiding the slug when a slug is fired.

34. A device as defined in claim 25 in which said guiding means consists of a single guiding portion spaced from the crossbow and having a groove which is parallel to and spaced from said longitudinal groove in the crossbow thereby forming said parallel grooves; said guiding portion, said crossbow and said grooves cooperating to guide a slug fired by the crossbow.

* * * * *